US007850793B2

(12) United States Patent
Nagao et al.

(10) Patent No.: US 7,850,793 B2
(45) Date of Patent: Dec. 14, 2010

(54) HOT MILLED WIRE ROD EXCELLING IN WIRE DRAWABILITY AND ENABLING AVOIDING HEAT TREATMENT BEFORE WIRE DRAWING

(75) Inventors: Mamoru Nagao, Hyogo (JP); Takeshi Kuroda, Hyogo (JP); Takaaki Minamida, Hyogo (JP)

(73) Assignee: Kobe Steel, Ltd., Kobe-shi (JP)

( * ) Notice: Subject to any disclaimer, the term of this patent is extended or adjusted under 35 U.S.C. 154(b) by 563 days.

(21) Appl. No.: 10/528,263

(22) PCT Filed: Sep. 24, 2003

(86) PCT No.: PCT/JP03/12121

§ 371 (c)(1),
(2), (4) Date: Mar. 17, 2005

(87) PCT Pub. No.: WO2004/029315

PCT Pub. Date: Apr. 8, 2004

(65) Prior Publication Data

US 2006/0048864 A1 Mar. 9, 2006

(30) Foreign Application Priority Data

Sep. 26, 2002 (JP) ..... 2002-281161
Jul. 30, 2003 (JP) ..... 2003-282947

(51) Int. Cl.
*C22C 38/00* (2006.01)

(52) U.S. Cl. ..... 148/320

(58) Field of Classification Search ..... 148/320
See application file for complete search history.

(56) References Cited

U.S. PATENT DOCUMENTS 3,320,101 A 5/1967 McLean et al.

(Continued)

FOREIGN PATENT DOCUMENTS

CN 1366555 8/2002

(Continued)

OTHER PUBLICATIONS

U.S. Appl. No. 11/296,299, filed Dec. 8, 2005, Minamida, et al.

(Continued)

*Primary Examiner*—Roy King
*Assistant Examiner*—Jie Yang
(74) *Attorney, Agent, or Firm*—Oblon, Spivak, McClelland, Maier & Neustadt, L.L.P.

(57) ABSTRACT

A hot-rolled wire rod:
the wire rod being a hot-rolled wire rod 5.0 mm or more in diameter, containing in mass
C: 0.6 to 1.0%,
Si: 0.1 to 1.5%,
Mn: 0.3 to 1.0%,
P: 0.02% or less, and
S: 0.02% or less;
not less than 90% of the wire rod in area percentage being composed of a pearlite structure; and
the mechanical properties of the wire rod 4 m in length satisfying the following expressions (1) to (4),
(1) TS*−30≦Average value of tensile strength ($TS_{AV}$ in MPa)≦TS*+30,
where, TS*=400×{[C]+([Mn]+[Si])/5}+670 and the elements in square brackets [ ] in the equality mean the contents of relevant elements in percentage,
(2) Standard deviation of tensile strength (TSσ)≦30 MPa,
(3) Average value of reduction of area ($RA_{AV}$)>35%,
(4) Standard deviation of reduction of area (RAσ)≦4%.

A hot-rolled wire rod according to the present invention is incomparably excellent in wire drawability and brakes less frequently than a conventional wire rod even when it is processed as hot-rolled with heat treatment such as patenting treatment omitted.

8 Claims, 3 Drawing Sheets

U.S. PATENT DOCUMENTS

| | | | | |
|---|---|---|---|---|
| 5,156,692 | A | 10/1992 | Tsukamoto | |
| 5,725,689 | A | 3/1998 | Nishida et al. | |
| 5,776,267 | A | 7/1998 | Nanba et al. | |
| 5,902,422 | A | 5/1999 | Meyer et al. | |
| 6,264,759 | B1 | 7/2001 | Bae et al. | |
| 6,322,641 | B1 | 11/2001 | Makii et al. | |
| 6,372,056 | B1 * | 4/2002 | Kuroda et al. | 148/320 |
| 6,605,166 | B2 | 8/2003 | Koike et al. | |
| 6,645,319 | B2 | 11/2003 | Nagao et al. | |
| 6,783,609 | B2 | 8/2004 | Hata et al. | |
| 6,800,147 | B2 | 10/2004 | Nagao et al. | |
| 2004/0129354 | A1 | 7/2004 | Nagao et al. | |

FOREIGN PATENT DOCUMENTS

| | | | |
|---|---|---|---|
| EP | 0 468 060 | A1 | 1/1992 |
| EP | 0 620 284 | A2 | 10/1994 |
| EP | 708182 | | 4/1996 |
| EP | 1 203 829 | A2 | 5/2002 |
| EP | 1 277 846 | A1 | 1/2003 |
| JP | 3-60900 | | 9/1991 |
| JP | 4-346618 | | 12/1992 |
| JP | 6-330239 | | 11/1994 |
| JP | 10-280051 | | 10/1998 |
| JP | 10-317098 | | 12/1998 |
| JP | 11-199977 | | 7/1999 |
| JP | 2000-63987 | | 2/2000 |
| JP | 2000-87186 | | 3/2000 |
| JP | 2000-178685 | | 6/2000 |
| JP | 2001-131697 | | 5/2001 |
| JP | 2001-179325 | | 7/2001 |
| JP | 2001-294981 | | 10/2001 |

OTHER PUBLICATIONS

Peter Spiekermann, "Legierungen-ein besonderes patentrechtliches Problem?-Legierungspruefung im Europaeischen Patentamt", Mitteilungen Der Deutschen Patentanwaelte, Heymann, Koln, XP-000961882, 1993, pp. 178-190.

Fujita et al, Sumitomo Metals, (1971) 23(3), pp. 63-68.

Kazuhlko Minami, et al. "Drawing High-Grade Steel Wire Rods without Heat Treatment" Wire Journal International, vol. 16, XP008063056, pp. (236-247), Sep. 1983.

U.S. Appl. No. 12/192,437, filed Aug. 15, 2008, Kochi, et al.

* cited by examiner

HOT MILLED WIRE ROD EXCELLING IN WIRE DRAWABILITY AND ENABLING AVOIDING HEAT TREATMENT BEFORE WIRE DRAWING

TECHNICAL FIELD

The present invention relates to a hot-rolled wire rod that has excellent wire drawability as it is hot-rolled and thus allows heat treatment prior to wire drawing to be omitted. A hot-rolled wire rod according to the present invention shows, over the entire length: not only tensile strength of a properly controlled average value and low variation; but also reduction of area of a high average value and low variation. It is therefore very useful as a material for the production of high-strength steel wires such as steel cords, tyre bead wires, steel wires for prestressed concrete, wire ropes, etc.

Here, a steel wire rod intended in the present invention is a hot-rolled wire rod 5.0 mm or more in diameter and this is determined in view of the fact that, in the case of the production of a conventional wire rod, the highest wire drawability is required in the process of drawing a high-carbon steel wire rod (based on JIS) 5.5 to 5.0 mm in diameter into a finally heat-treated wire 1.0 mm or so in diameter. In this light, the present invention provides a technology that further improves the wire drawability of a hot-rolled wire rod having the same diameter as a conventional wire rod.

BACKGROUND ART

Historically, a steel cord, a tyre bead wire or the like has generally been produced through the processes of: hot-rolling a high-carbon steel containing about 0.7 to 0.8% carbon (corresponding to JIS G3502 (SWRS72A and SWRS82A)); thereafter producing a steel wire rod about 5.0 to 6.4 mm in diameter by controlling the cooling conditions thereof; successively subjecting it to primary wire drawing, patenting treatment, secondary wire drawing, (secondary patenting treatment in the case of a steel cord), Cu—Zn dual phase plating and blueing treatment; and then finally applying wet wire drawing (finish wire drawing) and resultantly obtaining a prescribed wire diameter. Among the above processes, the patenting treatment (annealing treatment) is applied in order to obtain a fine pearlite structure that is beneficial to wire drawability. But, with the aim of improving productivity, enhancing energy saving, and reducing costs, promoted has been the development of a hot-rolled wire rod (direct-patenting wire rod) capable of omitting heat treatment such as patenting or the like.

For example, Patent document 1 (JP-B No. 60900/1991) proposes a wire rod defined by specifying the relationship among the carbon equivalent, tensile strength and coarse pearlite percentage of a high-carbon steel wire rod as a steel wire rod being excellent in drawing die service life and having a low frequency of wire breakage (refer to CLAIMS, from the line 19 in the first paragraph to the line 6 in the second paragraph, and from the line 7 to the line 33 in the fifth paragraph). According to the document, the average value of tensile strength is controlled in relation to a carbon equivalent particularly on the basis of the knowledge that "a direct-patenting wire rod has a certain optimum value in tensile strength and the wire breakage rate increases when the tensile strength is either lower or higher than the optimum value." As a result of the studies by the present inventors however, it has been clarified that there are cases where wire breakage cannot sufficiently be prevented from occurring during wire drawing even when such control measures are taken. Generally, in the case of a usual rolled wire rod, the mechanical properties thereof vary along the length (longitudinal portions), and the portions high in tensile strength and reduction of area and those low in tensile strength and reduction of area coexist therein. Hence, the portions locally high in strength or low in ductility are insufficiently controlled merely by regulating the average value of tensile strength as stipulated in the document, and the portions act as the origins of breakage during wire drawing and cause wire breakage.

Further, though it is not intended to propose a direct-patenting wire rod, as a method for enabling direct softening by slowly cooling a coil after hot-rolling, Patent document 2 (JP-A No. 179325/2001) discloses a method of controlling the cooling rate of the coil on a cooling conveyer after hot-rolling, the components of the steel material, the diameter of austenite grains at the start of the slow cooling, the wire diameter, the ring pitch, and the temperature of a slow cooling cover (refer to the paragraphs [0001], [0004], [0020] to [0026], and FIG. 1). However, the document does not include from the beginning the idea, of the present invention, that "it is essential to make a wire rod have the mechanical properties of low variation in order to provide a hot-rolled wire rod incomparably excellent in wire drawability." Hence, similarly to the case of Patent document 1, the portions extremely low in strength or low in ductility locally are still insufficiently controlled.

DISCLOSURE OF THE INVENTION

The present invention has been established in view of the above situation and the object thereof is to provide a hot-rolled wire rod that is incomparably excellent in wire drawability and brakes far less frequently than a conventional wire rod even when it is processed right after hot-rolling with heat treatment such as patenting treatment or the like omitted.

The gist of the present invention, which solves above problems, is a hot-rolled wire rod that has excellent wire drawability as it is hot-rolled and thus allows heat treatment prior to wire drawing to be omitted:

the hot-rolled wire rod being a hot-rolled wire rod 5.0 mm or more in diameter, containing in mass C: 0.6 to 1.0%, Si: 0.1 to 1.5%, Mn: 0.3 to 1.0%, P: 0.02% or less, and S: 0.02% or less;

not less than 90% of the wire rod in area percentage being composed of a pearlite structure; and the mechanical properties of the wire rod 4 m in length satisfying the following expressions (1) to (4), (1) $TS^*-30 \leqq$ Average value of tensile strength ($TS_{AV}$ in MPa) $\leqq TS^*+30$, where, $TS^*=400\times\{[C]+([Mn]+[Si])/5\}+670$ and the elements in square brackets [ ] in the equality mean the contents of relevant elements in percentage, (2) Standard deviation of tensile strength ($TS\sigma$) $\leqq 30$ MPa, (3) Average value of reduction of area ($RA_{AV}$) $>35\%$, (4) Standard deviation of reduction of area ($RA\sigma$) $\leqq 4\%$.

BEST MODE FOR CARRYING OUT THE INVENTION

Figure 1:
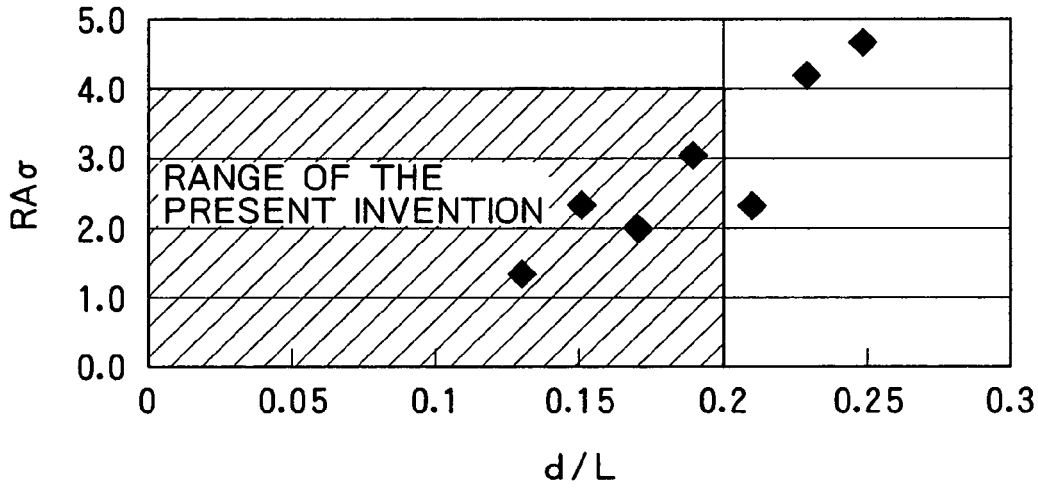
FIG. 1 is a graph showing the relationship between d/L and RAσ in the cases of Sample Nos. 8 to 14 by the cooling method B.

The present inventors have earnestly studied with the aim of providing a hot-rolled wire rod having further enhanced wire drawability as it is hot-rolled than a conventional wire rod. As a result of the studies, it has been found that, in order to secure good wire drawability: though it is necessary to control the average value ($TS_{AV}$) of tensile strength (TS) within a prescribed range by applying controlled cooling or the like after the end of hot-rolling as indicated in the aforementioned Patent documents, the mere application of the control means is still insufficient; and it is further necessary to raise the average value ($RA_{AV}$) of reduction of area (RA) which is an index of ductility. Moreover, it has also been found that when TS is lowered, the variation of RA increases, a desired $RA_{AV}$ value is not secured, and thus wire breakage caused by the local deterioration of ductility cannot be prevented from occurring. That is to say, it has been clarified that, in order to provide a "hot-rolled wire rod incomparably excellent in wire drawability" capable of further reducing the frequency of wire breakage than a conventional wire rod: it is insufficient merely to control a $TS_{AV}$ value at a low level; it is also necessary to control $RA_{AV}$ and the standard deviation of reduction of area (RAσ); and moreover it is essential to further control the standard deviation of tensile strength (TSσ) at a low level and secure a hot-rolled wire rod having less variable mechanical properties. Furthermore, the present inventors have found that, in order to obtain such a hot-rolled wire rod: it is insufficient merely to control hot-rolling conditions and regulate a cooling rate after coiling; and such a hot-rolled wire rod can be obtained only by controlling the loading density (d/L, d means a wire rod diameter and L a ring pitch) of the wire rod transferred onto a conveyer after rolling at a lower level than a conventional method. On the bases of the findings, the present invention has been established.

A wire rod according to the present invention is explained hereunder.

As mentioned earlier, a "hot-rolled wire rod, excellent in wire drawability, allowing heat treatment prior to wire drawing to be omitted" according to the present invention is characterized in that: the hot-rolled wire rod is a hot-rolled wire rod 5.0 mm or more in diameter, containing C of 0.6 to 1.0%, Si of 0.1 to 1.5%, and Mn of 0.3 to 1.0%; not less than 90% of the area of the structure thereof is composed of a pearlite structure; and the mechanical properties of the wire rod 4 m in length satisfy the aforementioned expressions (1) to (4).

[Structure]

In a hot-rolled wire rod according to the present invention, it is specified that not less than 90% of the area of the rolled wire rod structure is composed of a pearlite structure. The reason is that, when structures (intergranular ferrite, bainite and martensite) other than a pearlite structure increase and the area percentage of pearlite is less than 90%, the ductility thereof deteriorates. In order to secure excellent wire drawability, it is preferable to increase a pearlite structure as much as possible. A preferable area percentage of a pearlite structure is 95% or more and the best is 100% (a complete pearlite structure).

In a wire rod containing the steel components stipulated in the present invention (to be described later), though the area percentage of the pearlite structure in the rolled wire rod is generally 90% or more, in order to further increase the pearlite area percentage, it is further recommended, in particular, to properly control the cooling rate after the end of rolling.

In addition, with the aim of further enhancing the effect of the present invention, it is recommended to control the average diameter of nodules in a pearlite structure to 10 μm or less. Thereby, the wire drawability further improves and it becomes possible to inhibit wire breakage after wire drawing even when a drawing speed is increased (refer to Example 3 to be described later). From that point of view, it is preferable to decrease an average nodule diameter as much as possible. A preferable average nodule diameter is 8 μm or less, yet preferably 6 μm or less.

Here, the term nodule means a region wherein the crystal orientations of ferrite are identical in a pearlite structure, and an average diameter of nodules in a pearlite structure is measured by the following method.

Firstly, the orientations of ferrite are analyzed at intervals of 0.5 μm in a visual field of 200×200 μm square on a sectional area in the depth of D/4 of a rolled material (D means a wire rod diameter) with an SEM/EBSP (Electron Back Scatter Diffraction Pattern). Then the boundaries of crystals the orientations of which differ from each other by 15 degrees or more are identified as the grain boundaries of adjacent nodules, the number of nodule grain boundaries (N) on a line 800 μm in total length is measured by using the segment method, and the value of 800/N is defined as "the average diameter of nodules in a pearlite structure."

[Mechanical Properties]

In the present invention, a wire rod 4 m in consecutive length is sampled and the mechanical properties thereof are defined as indexes to obtain "a hot-rolled wire rod incomparably excellent in wire drawability." The reason why the length of a sample is set at 4 m (the length nearly corresponds to the perimeter of a wire rod coil) is based on: the experimental result that at least a length of 4 m is necessary in order to estimate the mechanical properties of the whole wire rod coil; and the view that, if the length is shorter than 4 m, errors tend to occur and, in contrast, if it is longer than that, it is not practically applicable.

A practical procedure may be done by sampling a wire rod 4 m in consecutive length arbitrarily from a whole wire rod coil, taking 16 pieces (n=16) of JIS #9B test specimens consecutively from the sampled wire rod, and measuring the mechanical properties of the test pieces.

Firstly, the aforementioned expressions (1) to (4) on mechanical properties that characterize a wire rod according to the present invention are explained.

(1) TS*−30≦Average value of tensile strength ($TS_{AV}$ in MPa)≦TS*+30, where, TS*=400×{([C]+([Mn]+[Si])/5}+670 and the elements in square brackets [ ] in the equality mean the contents of relevant elements in percentage.

In order to secure wire drawability in such a high-carbon steel wire rod as intended in the present invention, it is necessary to control $TS_{AV}$ properly. If $TS_{AV}$ is too high, the wire breakage rate increases and, in contrast, if it is too low, a structure effective in the improvement of wire drawability cannot be obtained. For that reason, in the present invention, $TS_{AV}$ is controlled within a prescribed range in relation to TS* (a value defined by the equality including the chemical components (C, Si and Mn) that contribute to the improvement of strength), and the range has been determined to be from TS*−30 to TS*+30, preferably from TS*−20 to TS*+20.

(2) Standard deviation of tensile strength (TSσ)≦30 MPa

In the present invention, it is necessary not only to control $TS_{AV}$ as usual but also to further control TSσ to 30 MPa or lower and thus to reduce the variation of TS. This is because it becomes possible thereby to lower the frequency of wire breakage further than a conventional wire rod. It is preferable to lower TSσ as much as possible. It is recommended that a TSσ value is 28 MPa or less, preferably 26 MPa or less.

(3) Average value of reduction of area ($RA_{AV}$)>35%

The reduction of area of a hot-rolled wire rod governs wire drawability at the primary stage after wire drawing. The present invention stipulates that $RA_{AV}$ is more than 35% on the basis of the view that the main factors determining wire drawability industrially are $RA_{AV}$ and RAσ that is to be mentioned later. If $RA_{AV}$ is 35% or lower, then the frequency of wire breakage at the primary stage of wire drawing increases. It is preferable to increase $RA_{AV}$ as much as possible. It is recommended that $RA_{AV}$ is 40% or more, preferably 45% or more.

(4) Standard deviation of reduction of area (RAσ)≦4%

As mentioned earlier, even though $RA_{AV}$ is well within a stipulated range, if there exist portions wherein reduction of area is extremely low, the portions act as sites of the local deterioration of ductility and as the origins of wire breakage. For that reason, in the present invention, RAσ is set at 4% or lower, thus reducing the variation of RA. It is preferable to lower RAσ as much as possible. It is recommended that RAσ is 3% or lower, preferably 2% or lower.

[Steel Components]

Next, chemical components contained in a wire rod according to the present invention are explained.

C: 0.6 to 1.0%

C is an element indispensable for securing a strength required of a wire rod and C of 0.6% or more is added accordingly. A C content is preferably 0.65% or more, yet preferably 0.7% or more. On the other hand, when a C content exceeds 1.0%, it becomes difficult to inhibit pro-eutectoid cementite, which functions as origins of wire breakage, in the cooling process after hot-rolling. A preferable C content is 0.95% or less.

Si: 0.1 to 1.5%

Si is an element that increases the strength of ferrite in pearlite and contributes to the adjustment of strength and is also useful as a deoxidizing agent. In order to exhibit such functions effectively, Si must be added by 0.1% or more and a preferable Si content is 0.12% or more. In contrast, when Si is added excessively, the ductility of ferrite in a steel is deteriorated and wire breakage is likely to occur. For that reason, the upper limit of an Si content is set at 1.5%, and a preferable Si content is 1.3% or less.

Mn: 0.3 to 1.0%

Mn is an element useful for securing the hardenability of a steel and enhancing the strength thereof. Mn of 0.3% or more (preferably 0.35% or more) is added in order to exhibit such functions effectively. In contrast, when Mn is added excessively, segregation occurs during cooling after hot-rolling and a supercooled structure, such as martensite, detrimental to wire drawability tends to form. For that reason, the upper limit of an Mn content is set at 1.0%. A preferable Mn content is 0.8% or less.

P: 0.02% or Less

P is an element that deteriorates the toughness and ductility of a steel and hence the upper limit thereof is set at 0.02% in order to prevent wire breakage in the processes of wire drawing and subsequent stranding. A P content is preferably 0.01% or less, yet preferably 0.005% or less.

S: 0.02% or Less

S, like P, is an element that deteriorates the toughness and ductility of a steel and hence the upper limit thereof is set at 0.02% in order to prevent wire breakage in the processes of wire drawing and subsequent stranding. A P content is preferably 0.01% or less, yet preferably 0.005% or less.

A wire rod according to the present invention contains the aforementioned components and the balance is composed of iron and unavoidable impurities. However, with the aim of further enhancing the effects of the present invention, it is recommended to further add the following elements.

Cr: 0.3% or Less (Excluding 0%) and/or Ni: 0.3% or Less (Excluding 0%)

Both Cr and Ni are elements that enhance hardenability and thus contribute to the increase of strength. It is recommended to add Cr and Ni by 0.1% or more respectively in order to exhibit such functions effectively. However, when they are added excessively, martensite tends to form. For that reason, the upper limit of each of Cr and Ni is set at 0.3% (preferably 0.25%), respectively. Those elements may be added independently or in combination.

At Least One Element Selected from Among the Group of Nb, V, Ti, Hf, and Zr May Be Added by 0.1% or Less (Excluding 0%) in Total.

Those are elements that precipitate fine carbonitride and thus contribute to the enhancement of strength. It is recommended to add Nb, V, Ti, Hf, and Zr by 0.003% or more respectively in order to exhibit such functions effectively. However, when they are added excessively, ductility deteriorates. For that reason, the upper limit of those elements is set at 0.1% (preferably 0.08%) in total. Those elements may be added independently or in combination.

N: 0.01% or Less

N is an element that deteriorates the toughness and ductility of a wire rod. Hence, on the basis of the view that a smaller content of N is desirable in order to prevent wire breakage and thus improve wire drawability, an N content is set at 0.01% or less (preferably 0.008% or less) in the present invention.

Al: 0.05% or Less and Mg: 0.01% or Less

Both the elements are usable as deoxidizing agents. However, when they are added excessively, oxide type inclusions such as $Al_2O_3$ and MgO—$Al_2O_3$ form abundantly and wire breakage caused by such inclusions occurs frequently. For that reason, the upper limits of Al and Mg are set at 0.05% and 0.01%, respectively. Preferable Al and Mg contents are 0.01% or less and 0.005% or less, respectively.

B: 0.001 to 0.005%

It is known that B exists as free-B dissolved in a steel and thus inhibits the formation of secondary phase ferrite, and the addition of B is effective particularly in producing a high strength wire rod requiring the suppression of longitudinal breakage. It is recommended to add B by 0.001% or more (preferably 0.002% or more) in order to secure a desired amount of free-B. However, even when B is added in excess of 0.005%, B precipitates as chemical compounds and deteriorates ductility. For that reason, the upper limit of B is set at 0.005%. A preferable B content is 0.004% or less.

In addition to the above-explained components, other components, including impurities, may be added in allowable ranges as long as the effects of the present invention are not hindered.

Next, a method for producing a wire rod according to the present invention is explained.

In order to obtain prescribed mechanical properties intended in the present invention, it is necessary to: heat a casting satisfying the aforementioned component regulations; hot-roll the casting to a wire rod of a prescribed diameter (5.5 or 5.0 mm); and thereafter subject the wire rod transferred onto a conveyer to controlled-cooling and control the loading density (d/L, d means the diameter of a wire rod and L a ring pitch (distance between adjacent two loops of a wire rod)) of the wire rod to 0.20 or less. The present invention is characterized particularly by regulating, while controlling, a rolling speed and a conveyer transfer speed so that a wire rod loaded on a conveyer after rolling may satisfy the expression $d/L \leqq 0.20$. In the case of a conventional wire rod, $TS_{AV}$ is controlled within a prescribed range by regulating the blast amount to a wire rod transferred onto a conveyer after hot-rolling or by taking a similar means. However, merely by that sort of means, $TS\sigma$ cannot be controlled and moreover desired values of $RA_{AV}$ and $RA\sigma$ are hardly secured.

Next, each process is explained hereunder.

Firstly, a casting satisfying the aforementioned component regulations is heated. Here, heating conditions are not particularly limited and it is possible to adopt conditions (for example, a temperature of 900° C. to 1,250° C.) usually employed in the production of an as-hot-rolled wire rod.

Next, the casting is hot-rolled to produce a wire rod of a prescribed diameter. Here, hot-rolling conditions are also not particularly limited and it is possible to adopt proper conditions as required so that desired mechanical properties may be obtained. For example, it is recommended to control a finish rolling temperature to 800° C. to 1,150° C. and a coiling temperature (a temperature at which a looped wire rod is placed on a floor and starts to be cooled) to 980° C. to 750° C.

After hot-rolled and coiled as described above, the rolled wire rod is transferred onto a conveyer (a Stelmor conveyer, for example). Here, it is necessary to control the cooling rate of the wire rod on the conveyer and regulate the loading density (d/L) of the relevant wire rod adequately.

The control of a cooling rate is necessary particularly for securing a prescribed $TS_{AV}$ Value. To be more precise, it is recommended to adopt double-step cooling; to rapidly cool a wire rod at an average cooling rate of 8 to 20° C./sec. (preferably 10 to 15° C./sec.) in the temperature range from 900° C. to 670° C., and then to slowly cool it at an average cooling rate of 1 to 5° C./sec. (preferably 1 to 3° C./sec.) in the temperature range from 670° C. to 500° C. The reason is that, with single-step cooling, when it is attempted to lower strength, ductility also lowers in proportion and thus required wire drawability cannot be obtained. Concretely, controlled cooling may be applied as mentioned above by, for example, using a Stelmor cooling device and regulating a blast amount.

Next, the loading density (d/L), which is one of the features of the present invention, of a wire rod is explained. As explained earlier, in order to obtain a wire rod having desired mechanical properties (particularly, a wire rod having mechanical properties of small variation), it is necessary to control d/L to 0.20 or less, and thereby an as-hot-rolled wire rod capable of conspicuously reducing the frequency of wire breakage in comparison with a conventional wire rod can be obtained. In the case of such an existing method as represented by the aforementioned Patent document 1 for example, it is estimated that, since the loading density of a wire rod transferred onto a conveyer is not so much taken into consideration and merely a cooling rate is regulated by means of the adjustment of a blast amount or the like, unevenness in the cooling rate appears in such a manner that the portions of large loading densities (namely, the portions where a wire rod accumulates thick) are cooled insufficiently and the portions of small loading densities (namely, the portions where a wire rod accumulates thin) are cooled rapidly and, in particular, the portions of slow cooling rates mainly cause TS and RA to vary. In this light, not only a cooling rate but also a loading density is also controlled in the present invention and thereby it becomes possible to keep a cooling rate constant at any portion of a wire rod (more precisely, the variation of the cooling rates at thick and thin portions is within 5° C./sec.), obtain a wire rod having mechanical properties of low variation, and resultantly improve wire drawability considerably. It is preferable to lower d/L as much as possible. A d/L value is preferably 0.18 or less, yet preferably 0.16 or less. Here, the lower limit of d/L is not particularly limited but, in consideration of productivity and others, it is recommended to control d/L to 0.10 or more, preferably 0.15 or more.

Meanwhile, the aforementioned Patent document 2 discloses the method of controlling average cooling rates separately at thick and thin portions of a wire rod coil in the temperature range (from 750° C. to 650° C.), most affecting the softening of the wire rod, in relation to the values of d, L and others when the coil is slowly cooled on a cooling conveyer after hot-rolling. However, the practical procedure is to slowly cool a wire rod at a cooling rate of 0.05 to 2.0° C./sec. in the temperature range as shown in FIG. 1, and the method is substantially different from the method, wherein a wire rod is cooled at a higher average cooling rate by controlling d/L to 0.20 or less, of the present invention. As a matter of fact, when the values of d/L are calculated on the basis of Table 3 shown in Patent document 2, all of the calculated values are 0.33 or more and thus any of the values disclosed in Patent document 2 exceeds the value stipulated in the present invention (0.20 or less). It is confirmed in the examples to be explained below that the properties intended in the present invention cannot be obtained with those values.

The aforementioned value d/L can be controlled by regulating the rolling speed of a wire rod and the transfer speed of a Stelmor conveyer or by other means. The value d is mainly determined particularly by the rolling speed of a wire rod and the value L is mainly determined by the transfer speed of a conveyer.

Further, in order to control the average diameter of nodules in a pearlite structure to 10 μm or less, it is particularly recommended to control a finish rolling temperature and a coiling temperature in an identical temperature range and also closely control the cooling process after coiling. To be more precise, a wire rod is: processed at a finish rolling temperature in the range from 750° C. to 900° C.; coiled while a coiling temperature is controlled also in the range from 750° C. to 900° C.; thereafter cooled up to a temperature of 600° C. to 630° C. within 10 sec. after the coiling; heated again to a temperature of 650° C. to 680° C. within 15 sec. after the cooling (namely, within 25 sec. after the coiling); and then cooled again.

Here, the purpose of controlling a finish rolling temperature in the range from 750° C. (preferably 800° C.) to 900° C. (preferably 850° C.) is to increase the area, per unit volume, of γ grain boundaries that are sites where nuclei of pearlite transformation form, and thereby it becomes possible to reduce the average diameter of nodules of pearlite to 10 μm or less. If a finish rolling temperature is lower than 750° C. in particular, recrystallization does not occur at rolling, pearlite transformation is induced from the inside of γ grains, the rolled material structure becomes uneven, and resultantly wire drawability deteriorates. Here, the lower limit of a finish rolling temperature can be lowered up to 750° C. in comparison with the case where a nodule diameter is not controlled to 10 μm or less (the preferable lower limit of a finish rolling temperature in this case is 800° C.). This is because, in the case where a nodule diameter is controlled to 10 μm or less, the cooling process after coiling is precisely controlled and as a result a wire rod having mechanical properties of small variation can be obtained even when a finish rolling temperature is as low as 750° C.

Further, the reason to control a coiling temperature in the range from 750° C. (preferably 780° C.) to 900° C. (preferably 880° C.) is that: when it exceeds 900° C., a prescribed area of γ grain boundaries cannot be secured in the same manner as the case of the finish rolling temperature; and in contrast, when it is lower than 750° C., it becomes difficult to coil a wire rod into loops.

Furthermore, the purpose of cooling a wire rod up to a temperature of 600° C. to 630° C. within 10 sec. (preferably 8 sec.) after coiling is to commence pearlite transformation in the temperature range and thus to secure a prescribed strength. When a wire rod is cooled in the temperature range in excess of 10 sec. after coiling, the transformation temperature becomes higher than 630° C. and the average nodule diameter exceeds 10 μm though the strength lowers.

The purpose of heating a wire rod again up to a temperature of 650° C. to 680° C. within 15 sec. (preferably within 13 sec.) after cooling, namely within 25 sec. after coiling, is to control the mechanical properties ($TS_{AV}$, TSσ, $RA_{AV}$ and RAσ) in the ranges stipulated by the expressions (1) to (4) in the present invention. When a heating temperature is lower than 650° C., the average strength ($TS_{AV}$) exceeds the range stipulated in the present invention and thus the effect of the present invention in improving wire drawability, particularly the effect in improving die service life, cannot be obtained sufficiently. On the other hand, when a wire rod is heated in excess of 680° C., the average nodule diameter exceeds 10 μm. Likewise, when it takes more than 15 sec. for the heating, nodules having the diameter of more than 10 μm are formed. Here, with regard to heating operation, a heating means may be applied intentionally but it is also possible to make use of the recuperation of pearlite transformation.

With regard to the cooling after heating, nothing is particularly specified. However, in order to obtain a desired nodule diameter, it is desirable that the cooling rate is as high as possible and, for example, it is recommended that a cooling rate is 5° C./sec. or higher.

The present invention makes it possible for a wire rod, even in the stare of as hot-rolled, to have excellent wire drawability. Further, even after such a wire rod is further subjected to scale removal by adding acid (hydrochloric acid, sulfuric acid, or the like), mechanical strain, or the like and thereafter to wire drawing, cold-rolling and other treatments by using a zinc phosphate film, a calcium phosphate film, lime, metallic soap, or others as a lubricant, the wire rod can still keep the excellent wire drawability. Hence, a wire rod subjected to such treatments is also included in the present invention.

The present invention is hereunder explained in detail on the basis of examples. However, note that the examples described below do not restrict the scope of the present invention and any of the modifications to the extent of not deviating from the tenor of the present invention is included in the technological scope of the present invention.

Example 1

Consideration of Production Conditions

In the present example, the cooling rates after rolling and the loading densities (d/L) were changed variously and the influences thereof on the mechanical properties were investigated.

To be more precise, a casting comprising 0.82% C-0.21% Si-0.51% Mn was heated to 1,150° C. and hot-rolled (the finish rolling temperature being 800° C. to 900° C.), and a wire rod 5.5 or 5.0 mm in diameter was produced. The coiled wire rod was subjected to a Stelmor cooling device, the average cooling rate on a Stelmor conveyer was controlled by any one of the following cooling methods A to C, the loading density was controlled to be in the range from 0.13 to 0.22 by regulating the rolling speed and the Stelmor conveyer transfer speed, and thus a 2-ton coil was produced.

Cooling Method A (a Method According to the Present Invention)

The average cooling rate was controlled to 10° C./sec. in the temperature range from 900° C. to 670° C. and the average cooling rate was controlled to 5° C./sec. in the temperature range from 670° C. to 500° C.

Cooling Method B (a Method Deviated from the Present Invention)

The entire average cooling rate was controlled to 5° C./sec. in the temperature range from 900° C. to 500° C.

Cooling Method C (a Method Deviated from the Present Invention)

The entire average cooling rate was controlled to 2° C./sec. in the temperature range from 900° C. to 500° C.

A wire rod 20 m in length was cut out from the rolling top portion of the produced wire rod coil and then a wire rod 4 m in length was sampled out of the length of 20 m. 16 JIS #9B test pieces were prepared from the sampled wire rod and subjected to tensile test, and thereby the average value of tensile strength ($TS_{AV}$), the standard deviation of tensile strength (TSσ), the average value of reduction of area ($RA_{AV}$), and the standard deviation of reduction of area (RAσ) were measured, respectively.

Further, the structure (pearlite area percentage) of the wire rod coil was measured by observation with a scanning electron microscope (3,000 magnifications).

Furthermore, the wire rod coil was subjected to wire drawing test and the frequency of wire breakage (per ton) was measured by drawing it up to a diameter of 1.2 or 0.9 mm. In the wire drawing test, a continuous drawing machine equipped with 7 dies was used and the wire rod was subjected to turn-back drawing. The die angle and the drawing speed were set at 12° and 300 m/min., respectively.

Figure 2:
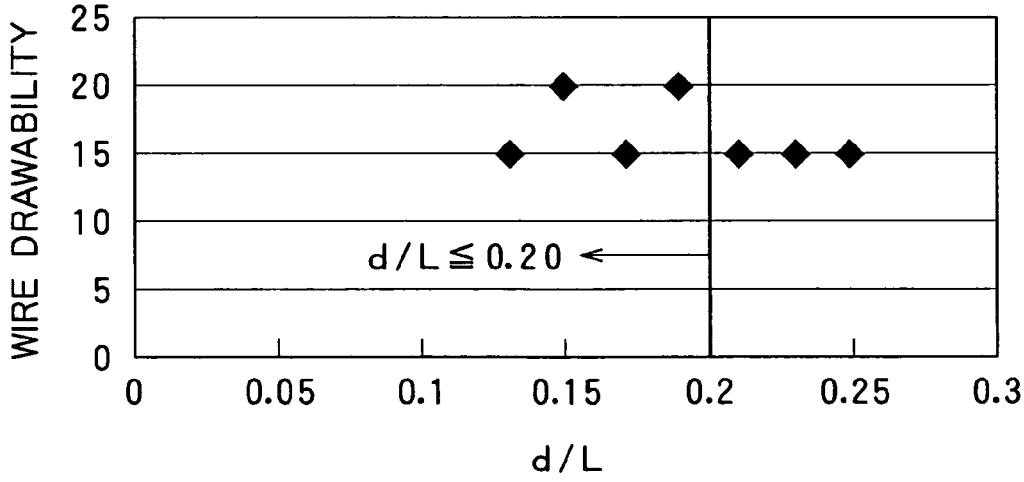
FIG. 2 is a graph showing the relationship between d/L and wire drawability (wire breakage frequency at drawing up to a diameter of 1.2 mm) in the cases of Sample Nos. 8 to 14 by the cooling method B.
Figure 3:
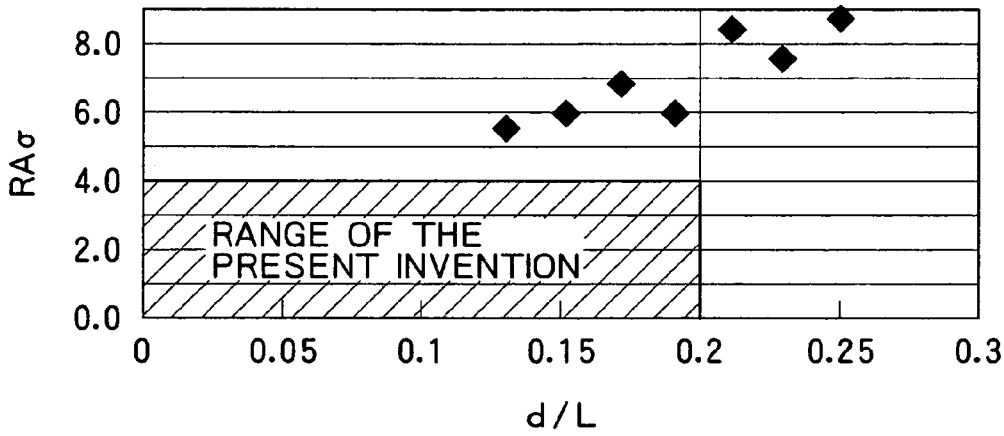
FIG. 3 is a graph showing the relationship between d/L and RAσ in the cases of Sample Nos. 15 to 21 by the cooling method C.
Figure 4:
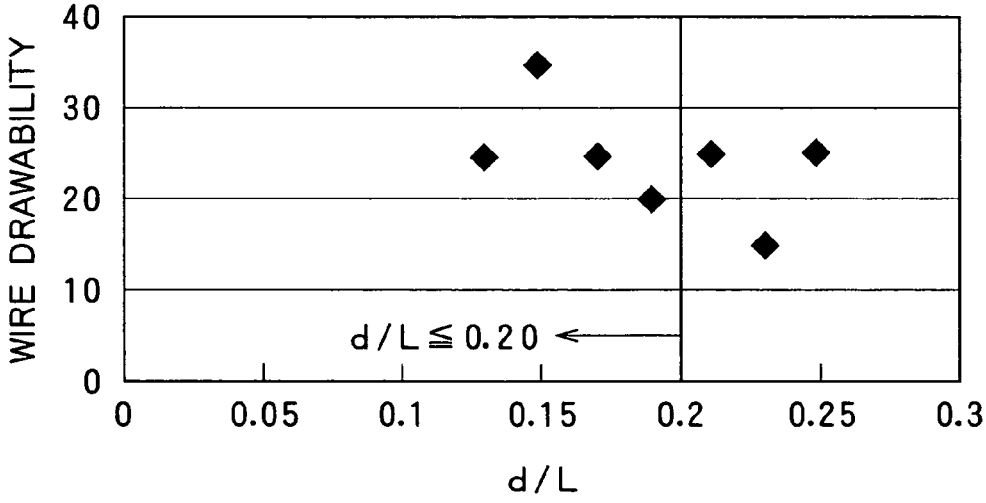
FIG. 4 is a graph showing the relationship between d/L and wire drawability (wire breakage frequency at drawing up to a diameter of 1.2 mm) in the cases of Sample Nos. 15 to 21 by the cooling method C.
Figure 5:
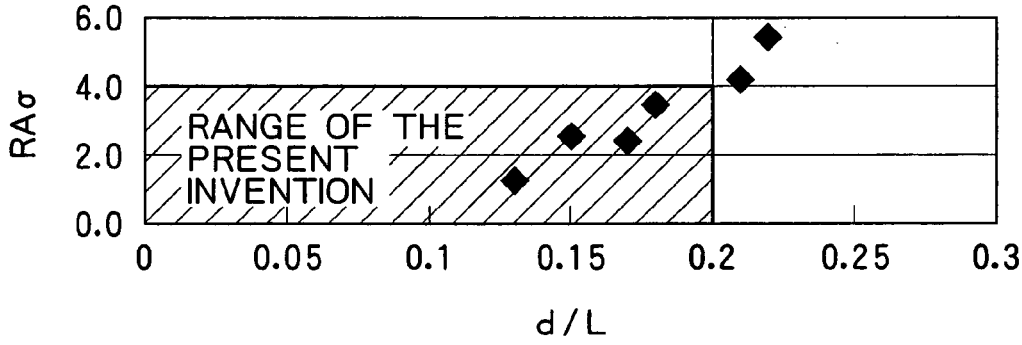
FIG. 5 is a graph showing the relationship between d/L and RAσ in the cases of Sample Nos. 1 to 6 by the cooling method A.
Figure 6:
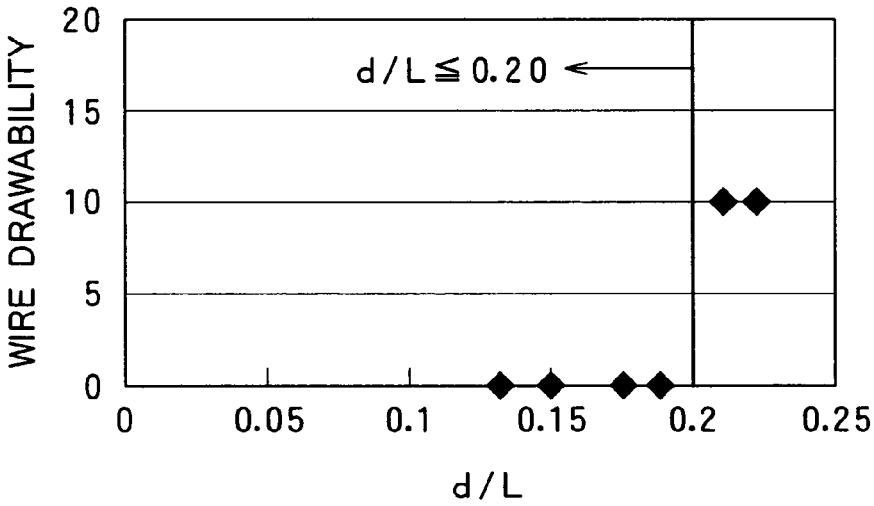
FIG. 6 is a graph showing the relationship between d/L and wire drawability in the cases of Sample Nos. 1 to 6 by the cooling method A.

The test results are put together into Table 1 and some of the test results are extracted from the table and shown graphically in FIGS. 1 to 6. FIGS. 1 and 2 show graphically the results of the cases Nos. 8 to 14 where the cooling method B was adopted, and FIG. 1 shows the relationship between d/L and RAσ and FIG. 2 the relationship between d/L and wire drawability (wire breakage frequency up to the drawing diameter of 1.2 mm). FIGS. 3 and 4 show graphically the results of the cases Nos. 15 to 21 where the cooling method C was adopted, and FIG. 3 shows the relationship between d/L and RAσ and FIG. 4 the relationship between d/L and wire drawability (wire breakage frequency up to the drawing diameter of 1.2 mm). FIGS. 5 and 6 show graphically the results of the cases Nos. 1 to 6 where the cooling method A was adopted, and FIG. 5 shows the relationship between d/L and RAσ and FIG. 6 the relationship between d/L and wire drawability (wire breakage frequency up to the drawing diameter of 1.2 mm).

Note that, the pearlite area percentage in any of the structures of the wire rod coil produced in Example 1 was 90% or more (not shown in the table).

[Table 1]

Firstly, the cases Nos. 8 to 14 are examples of adopting the cooling method B and changing the loading density d/L in the range from 0.13 to 0.25 by controlling the rolling speed and conveyer transfer speed. In any of the cases, since the wire rod was produced at as low a cooling rate as 5° C./sec., $TS_{AV}$ increased though $RA_{AV}$ was controlled in the prescribed range. In such a case, even though TSσ and RAσ were controlled at lower levels by controlling d/L in the range stipulated in the present invention as seen in the cases Nos. 8 to 11, the wire drawability deteriorated (refer to FIGS. 1 and 2).

Next, the cases Nos. 15 to 21 are examples of adopting the cooling method C and changing the loading density d/L in the range from 0.13 to 0.25 by controlling the rolling speed and conveyer transfer speed. In any of the cases, since the wire rod was produced at a very low cooling rate of 2° C./sec., which was far lower than that of the cases Nos. 8 to 14, $TS_{AV}$ and $RA_{AV}$ were low. In such a case, even though TSσ was controlled at a lower level by controlling d/L in the range stipulated in the present invention as seen in the cases Nos. 15 to 18, RAσ could not be reduced and the wire drawability deteriorated (refer to FIGS. 3 and 4).

In contrast, the cases Nos. 1 to 8 are examples of adopting the cooling method A and changing the loading density d/L in the range from 0.13 to 0.25 by controlling the rolling speed and conveyer transfer speed.

In those cases, the cases Nos. 1 to 4 are examples according to the present invention since the production conditions were controlled properly and d/L was well within the range stipulated in the present invention. Here, $TS_{AV}$, TSσ, $RA_{AV}$ and RAσ were all well controlled within the ranges stipulated in the present invention and the wire drawability was incomparably excellent. In the case No. 4 in particular, the wire rod didn't break at all even when it was drawn up to a diameter of 0.90 mm.

On the other hand, in the cases Nos. 5 and 6, though $TS_{AV}$ and $RA_{AV}$ were within the ranges stipulated in the present invention since the cooling rate was controlled properly, d/L exceeded the range stipulated in the present invention. As a result, TSσ and RAσ increased beyond the ranges stipulated in the present invention (large variations) and wire drawability was inferior (refer to FIGS. 5 and 6).

Also, in the case No. 7, d/L was outside the range stipulated in the present invention and hence RAσ increased and wire drawability deteriorated.

It has been found from the above results that it becomes possible to provide a hot-rolled wire rod far more excellent in wire drawability than a conventional one only by controlling all the properties of $TS_{AV}$, $RA_{AV}$, TSσ and RAσ in the ranges stipulated in the present invention.

Example 2

Consideration of Chemical Components

In the present example, the steel components were changed variously while the production conditions were kept constant and the influences thereof on the mechanical properties were investigated.

To be more precise, a casting comprising the components shown in Table 3 was hot-rolled under the same conditions as Example 1 and a wire rod 5.0 mm in diameter was produced. Thereafter, the produced wire rod was subjected to a Stelmor cooling device, the average cooling rate on a conveyer was controlled by the aforementioned cooling method A, the loading density was controlled to be in the range from 0.13 to 0.20 by regulating the rolling speed and conveyer transfer speed, and thus a wire rod coil was produced. The mechanical properties and wire drawability of the produced wire rod coil were measured in the same way as Example 1. The results are shown in Table 3. Note that, the pearlite area percentage in any of the structures of the wire rod coil produced in Example 2 was 90% or more (not shown in the table).

[Tables 2 and 3]

From Table 3, the following consideration can be derived.

Firstly, any of the cases Nos. 1 to 5 is an example of using a steel having a chemical composition stipulated in the present invention and also $TS_{AV}$, TSσ, $RA_{AV}$ and RAσ are all within the ranges stipulated in the present invention. Hence no wire breakage occurred even when the wire rod was drawn up to a diameter of 1.2 mm and moreover the frequency of wire breakage was not more than five times even when the wire rod was further drawn up to 0.90 mm and thus incomparably excellent wire drawability was obtained.

In contrast, the case No. 6 is an example of an excessive C amount, the case No. 7 an example of an excessive Si amount, the case No. 8 an example of an excessive Mn amount, and case No. 9 an example of excessive P and S amounts. In any of the cases, the wire breakage frequency considerably increased up to 10 to 15 times when the wire rod was drawn up to a diameter of 1.2 mm and, though drawing up to a diameter of 0.90 mm was further attempted, it was unsuccessful and had to be given up.

In the case No. 10, the amounts of C, Si, Mn, P and S are controlled appropriately. Hence the wire breakage frequency was as low as 5 times or less when the wire rod was drawn up to a diameter of 1.2 mm. However, the amounts of Cr and Ni are excessive and hence the wire breakage frequency increased to 15 times when the wire rod was drawn up to a diameter of 0.90 mm.

The case of No. 11 is an example of containing excessive amounts of Mg and Al. In either of the cases, oxide-type inclusions formed in quantity and hence the wire breakage frequency increased to 10 times when the wire rod was drawn up to a diameter of 0.90 mm.

The case of No. 12 is an example of containing an excessive amount of N. In this case, ductility deteriorated and hence the wire breakage frequency increased to 10 times when the wire rod was drawn up to a diameter of 0.90 mm.

The case of No. 13 is an example of containing an excessive amount of B. In this case, ductility deteriorated and hence the wire breakage frequency increased to 15 times when the wire rod was drawn up to a diameter of 0.90 mm.

Example 3

Consideration of the Average Diameter of Nodules in a Pearlite Structure

A casting having the composition of 0.82% C-0.18% Si-0.5% Mn was heated to 1,150° C., then hot-rolled and coiled under the conditions shown in Table 4, and a wire rod 5.5 or 5.0 mm in diameter was produced. The coiled wire rod was subjected to a Stelmor cooling device, the cooling conditions and loading density were adjusted as shown in Table 4 on a Stelmor conveyer, and a 2-ton coil was produced.

The mechanical properties and structure of the produced wire rod coil were measured by the same method as Example 1 and the average diameter of nodules in the pearlite structure was also measured by the aforementioned method. The wire drawability was measured under the same conditions as Example 1 except that the wire breakage frequency (per ton) was measured at two drawing speeds of 300 and 500 m/min. when the wire drawing test was carried out up to a diameter of 1.2 mm.

The results are shown in Table 5.

[Tables 4 and 5]

From Table 5, the following consideration can be derived.

Firstly, the cases Nos. 1 to 12 are examples of controlling rolling conditions, coiling conditions, and cooling conditions after coiling properly and reducing the average diameter of nodules in a pearlite structure to 10 μm or less. In comparison with Examples 1 and 2, in those cases, no wire breakage was observed even when wire drawing was applied under severer conditions (the drawing speed was raised from 300 to 500 m/min. in the drawing up to a diameter of 1.2 mm) and thus it was recognized that the wire drawability was incomparably excellent.

In contrast, the cases Nos. 13 to 18 are examples wherein either of the rolling conditions or the cooling conditions after coiling were controlled improperly and hence the average nodule diameter exceeded 10 μm. To be more specific, the case No. 13 is an example wherein the finish rolling temperature was high and the heating temperature after a lapse of 25 sec. from coiling was low, the case No. 14 an example wherein the finish rolling temperature and the cooling temperature after a lapse of 10 sec. from coiling were high and the heating temperature after a lapse of 25 sec. from coiling was low, the case No. 15 an example wherein the cooling temperature after a lapse of 10 sec. from coiling was high and the heating temperature after a lapse of 25 sec. from coiling was low, the case No. 16 an example wherein both the cooling temperature after a lapse of 10 sec. from coiling and the heating temperature after a lapse of 25 sec. from coiling were low, the case No. 17 an example wherein the heating temperature after a lapse of 25 sec. from coiling was low, and the case No. 18 an example wherein both the finish rolling temperature and the cooling temperature after a lapse of 10 sec. from coiling were high. In those cases, whereas the wire breakage frequency at a drawing speed of 300 m/min. was preferably 4 times or less, at a drawing speed of 500 m/min., the wire drawability was deteriorated considerably in comparison with the cases Nos. 1 to 12 where the average nodule diameter was controlled to 10 μm or less. Consequently, the wire breakage frequency of 4.5 to 5.5 times was observed (the cases Nos. 14 and 18) or wire drawing had to be discontinued (the cases Nos. 13 and 15 to 17).

INDUSTRIAL APPLICABILITY

The present invention makes it possible to provide a hot-rolled wire rod that is incomparably excellent in wire drawability and brakes less frequently than a conventional wire rod even when it is processed as hot-rolled with heat treatment such as patenting treatment omitted.

TABLE 1

| Sample No. | Controlled cooling | Rolled wire diameter mm | Loading density d/L | Mechanical properties: $TS_{AV}$ Measured value | $TS_{AV}$ Computed value | TSσ | $RA_{AV}$ | RAσ | Wire drawability 1.2 mm* | Wire drawability 0.90 mm** |
|---|---|---|---|---|---|---|---|---|---|---|
| 1 | A | 5.5 | 0.18 | 1059 | 1056 ± 30 | 22 | 42 | 3.6 | 0 | 5 |
| 2 | A | 5.5 | 0.17 | 1085 | 1056 ± 30 | 24 | 41 | 2.5 | 0 | 5 |
| 3 | A | 5.0 | 0.15 | 1054 | 1056 ± 30 | 21 | 42 | 2.7 | 0 | 5 |
| 4 | A | 5.0 | 0.13 | 1062 | 1056 ± 30 | 18 | 38 | 1.5 | 0 | 0 |
| 5 | A | 5.5 | 0.21 | 1072 | 1056 ± 30 | 33 | 38 | 4.2 | 10 | — |
| 6 | A | 5.0 | 0.22 | 1048 | 1056 ± 30 | 32 | 37 | 5.6 | 10 | — |
| 7 | A | 5.0 | 0.23 | 1062 | 1056 ± 30 | 25 | 36 | 8.3 | 10 | — |
| 8 | B | 5.5 | 0.13 | 1120 | 1056 ± 30 | 16 | 45 | 1.4 | 15 | — |
| 9 | B | 5.5 | 0.15 | 1131 | 1056 ± 30 | 13 | 44 | 2.4 | 20 | — |
| 10 | B | 5.5 | 0.17 | 1092 | 1056 ± 30 | 15 | 43 | 2.0 | 15 | — |
| 11 | B | 5.5 | 0.19 | 1145 | 1056 ± 30 | 13 | 42 | 3.1 | 20 | — |
| 12 | B | 5.5 | 0.21 | 1190 | 1056 ± 30 | 15 | 43 | 2.4 | 15 | — |
| 13 | B | 5.5 | 0.23 | 1115 | 1056 ± 30 | 18 | 44 | 4.2 | 15 | — |
| 14 | B | 5.5 | 0.25 | 1133 | 1056 ± 30 | 17 | 46 | 4.7 | 15 | — |
| 15 | C | 5.5 | 0.13 | 1011 | 1056 ± 30 | 22 | 32 | 5.6 | 25 | — |
| 16 | C | 5.5 | 0.15 | 1088 | 1056 ± 30 | 21 | 33 | 6.2 | 35 | — |
| 17 | C | 5.0 | 0.17 | 989 | 1056 ± 30 | 23 | 34 | 7.0 | 25 | — |
| 18 | C | 5.0 | 0.19 | 1020 | 1056 ± 30 | 23 | 34 | 6.2 | 20 | — |
| 19 | C | 5.0 | 0.21 | 988 | 1056 ± 30 | 22 | 30 | 8.5 | 25 | — |
| 20 | C | 5.5 | 0.23 | 1003 | 1056 ± 30 | 21 | 31 | 7.8 | 15 | — |
| 21 | C | 5.5 | 0.25 | 995 | 1056 ± 30 | 20 | 32 | 8.8 | 25 | — |

Note:

*Wire breakage frequency (per ton) up to a wire drawing diameter of 1.2 mm

**Wire breakage frequency (per ton) up to a wire drawing diameter of 0.90 mm

—Wire drawing discontinued

TABLE 2

| Steel | Chemical components (mass %) | | | | | | | | | | |
|---|---|---|---|---|---|---|---|---|---|---|---|
| No. | C | Si | Mn | P | S | Cr | Ni | N | Al | B | Others |
| 1 | 0.90 | 0.25 | 0.40 | 0.005 | 0.007 | 0.18 | 0.03 | 0.005 | 0.003 | — | — |
| 2 | 0.85 | 0.18 | 0.75 | 0.007 | 0.009 | 0.01 | 0.01 | 0.007 | 0.020 | 0.0015 | V = 0.05, Ti = 0.02 |
| 3 | 0.77 | 0.85 | 0.42 | 0.005 | 0.002 | 0.01 | 0.01 | 0.005 | 0.003 | 0.0021 | Nb = 0.02, Zr = 0.02 |
| 4 | 0.72 | 0.20 | 0.78 | 0.015 | 0.011 | 0.01 | 0.30 | 0.005 | 0.040 | — | Mg = 0.008 |
| 5 | 0.95 | 0.20 | 0.40 | 0.005 | 0.001 | 0.30 | 0.15 | 0.004 | 0.015 | 0.0020 | — |
| 6 | 1.20 | 0.54 | 0.67 | 0.005 | 0.007 | 0.01 | 0.01 | 0.008 | 0.005 | — | — |
| 7 | 0.90 | 1.60 | 0.44 | 0.009 | 0.005 | 0.21 | 0.01 | 0.009 | 0.007 | — | Hf = 0.04 |
| 8 | 0.77 | 0.55 | 1.04 | 0.015 | 0.005 | 0.01 | 0.01 | 0.005 | 0.025 | — | — |
| 9 | 0.82 | 0.19 | 0.55 | 0.022 | 0.021 | 0.01 | 0.01 | 0.005 | 0.003 | — | Ti = 0.01 |
| 10 | 0.92 | 0.15 | 0.77 | 0.010 | 0.010 | 0.35 | 0.31 | 0.025 | 0.004 | — | — |
| 11 | 0.85 | 0.17 | 0.44 | 0.009 | 0.006 | 0.01 | 0.01 | 0.021 | 0.060 | — | Mg = 0.05 |
| 12 | 0.65 | 0.15 | 0.77 | 0.005 | 0.009 | 0.01 | 0.01 | 0.015 | 0.004 | 0.0026 | — |
| 13 | 0.77 | 0.19 | 0.56 | 0.007 | 0.008 | 0.01 | 0.01 | 0.002 | 0.003 | 0.0055 | — |

TABLE 3

| Steel | Mechanical properties | | | | | | |
|---|---|---|---|---|---|---|---|
| | $TS_{AV}$ (MPa) | | TSσ | $RA_{AV}$ | RAσ | Wire drawability | |
| No. | Measured value | Computed value | (MPa) | (%) | (%) | 1.2 mm* | 0.90 mm** |
| 1 | 1089 | 1082 ± 30 | 23 | 39 | 3.2 | 0 | 5 |
| 2 | 1092 | 1084 ± 30 | 24 | 39 | 3.6 | 0 | 5 |
| 3 | 1055 | 1080 ± 30 | 22 | 45 | 3.8 | 0 | 5 |
| 4 | 1052 | 1036 ± 30 | 24 | 42 | 3.1 | 0 | 5 |
| 5 | 1110 | 1098 ± 30 | 23 | 40 | 2.5 | 0 | 5 |
| 6 | 1310 | 1247 ± 30 | 18 | 41 | 4.2 | 15 | Wire drawing discontinued |
| 7 | 1252 | 1193 ± 30 | 19 | 36 | 4.5 | 10 | Wire drawing discontinued |
| 8 | 1235 | 1103 ± 30 | 18 | 37 | 3.8 | 15 | Wire drawing discontinued |
| 9 | 1120 | 1057 ± 30 | 18 | 32 | 4.5 | 15 | Wire drawing discontinued |
| 10 | 1245 | 1112 ± 30 | 22 | 37 | 4.1 | 5 | 15 |
| 11 | 1075 | 1059 ± 30 | 24 | 38 | 4.8 | 0 | 10 |
| 12 | 989 | 1004 ± 30 | 29 | 36 | 3.8 | 0 | 10 |
| 13 | 1025 | 1038 ± 30 | 28 | 41 | 3.8 | 0 | 15 |

Note:
*Wire breakage frequency (per ton) up to a wire drawing diameter of 1.2 mm
**Wire breakage frequency (per ton) up to a wire drawing diameter of 0.90 mm

TABLE 4

| Steel No. | Finish rolling temperature (° C.) | Coiling temperature (° C.) | Temperature after a lapse of 10 sec. from coiling (° C.) | Temperature after a lapse of 25 sec. from coiling (° C.) | Subsequent cooling rate (° C./sec.) | d/L |
|---|---|---|---|---|---|---|
| 1 | 800 | 800 | 615 | 670 | 4 | 0.16 |
| 2 | 750 | 750 | 600 | 665 | 4 | 0.18 |
| 3 | 850 | 850 | 625 | 660 | 4 | 0.14 |
| 4 | 880 | 770 | 610 | 670 | 4 | 0.15 |
| 5 | 830 | 750 | 600 | 660 | 4 | 0.15 |
| 6 | 820 | 750 | 630 | 670 | 4 | 0.15 |
| 7 | 820 | 750 | 600 | 650 | 4 | 0.15 |
| 8 | 800 | 750 | 620 | 660 | 4 | 0.15 |
| 9 | 800 | 750 | 625 | 670 | 4 | 0.15 |
| 10 | 820 | 760 | 610 | 660 | 7 | 0.15 |
| 11 | 825 | 825 | 615 | 650 | 8 | 0.16 |
| 12 | 825 | 825 | 615 | 660 | 8 | 0.20 |
| 13 | 910 | 800 | 620 | 640 | 6 | 0.15 |
| 14 | 910 | 900 | 650 | 630 | 8 | 0.15 |
| 15 | 860 | 800 | 640 | 635 | 7 | 0.15 |
| 16 | 830 | 820 | 580 | 545 | 6 | 0.15 |
| 17 | 825 | 800 | 610 | 590 | 7 | 0.15 |
| 18 | 920 | 850 | 750 | 660 | 5 | 0.18 |

TABLE 5

| Steel No. | Pearlite area percentage (%) | Average nodule diameter (μm) | Mechanical properties: $TS_{AV}$ (MPa) Measured value | $TS_{AV}$ (MPa) Computed value | TSσ (MPa) | $RA_{AV}$ (%) | RAσ (%) | Wire drawability* 300 m/minute | Wire drawability* 600 m/minute |
|---|---|---|---|---|---|---|---|---|---|
| 1 | 95 | 9.5 | 1037 | 1052 ± 30 | 25 | 42 | 3.7 | 0 | 0 |
| 2 | 95 | 8.6 | 1037 | 1052 ± 30 | 24 | 40 | 3.5 | 0 | 0 |
| 3 | 95 | 9.6 | 1050 | 1052 ± 30 | 25 | 40 | 3.7 | 0 | 0 |
| 4 | 95 | 9.9 | 1036 | 1052 ± 30 | 27 | 41 | 3.5 | 0 | 0 |
| 5 | 95 | 9.3 | 1038 | 1052 ± 30 | 25 | 41 | 3.7 | 0 | 0 |
| 6 | 95 | 9.0 | 1025 | 1052 ± 30 | 28 | 42 | 3.5 | 0 | 0 |
| 7 | 95 | 9.2 | 1025 | 1052 ± 30 | 24 | 40 | 3.8 | 0 | 0 |
| 8 | 95 | 9.1 | 1033 | 1052 ± 30 | 28 | 42 | 3.7 | 0 | 0 |
| 9 | 95 | 9.6 | 1048 | 1052 ± 30 | 26 | 38 | 3.6 | 0 | 0 |
| 10 | 95 | 8.7 | 1045 | 1052 ± 30 | 26 | 39 | 3.7 | 0 | 0 |
| 11 | 95 | 9.0 | 1031 | 1052 ± 30 | 27 | 40 | 3.6 | 0 | 0 |
| 12 | 95 | 8.8 | 1040 | 1052 ± 30 | 26 | 44 | 3.5 | 0 | 0 |
| 13 | 90 | 13.5 | 1045 | 1052 ± 30 | 28 | 33 | 4.2 | 2.5 | Wire drawing discontinued |
| 14 | 95 | 12.1 | 1049 | 1052 ± 30 | 29 | 35 | 3.9 | 0 | 4.5 |
| 15 | 96 | 10.8 | 1033 | 1052 ± 30 | 29 | 35 | 4.1 | 3.5 | Wire drawing discontinued |
| 16 | 96 | 11.5 | 1068 | 1052 ± 30 | 27 | 34 | 3.1 | 4 | Wire drawing discontinued |
| 17 | 96 | 12.4 | 1086 | 1052 ± 30 | 21 | 33 | 2.5 | 3 | Wire drawing discontinued |
| 18 | 97 | 11.5 | 1059 | 1052 ± 30 | 22 | 42 | 3.6 | 0 | 5.5 |

Note:
*Wire breakage frequency (per ton) up to a wire drawing diameter of 1.2 mm

The invention claimed is:

1. A hot-rolled wire rod obtained by hot rolling a steel composition comprising (in mass %):

C: 0.6 to 1.0%,

Si: 0.1 to 0.85%,

Mn: 0.3 to 1.0%,

Cr: 0.3% or less, excluding zero %,

P: 0.01% or less, and

S: 0.02% or less;

performing a first cooling of the wire rod at an average cooling rate of 8 to 20° C./sec in a temperature range of from 900 to 670° C.; and performing a second cooling of the wire rod at an average cooling rate of 1 to 5° C./sec in a temperature range of from 670 to 500° C.;

wherein said hot-rolled wire rod is 5.0 mm or more in diameter;

not less than 90% of said wire rod in area percentage comprises a pearlite structure;

a loading density (d/L) of said wire rod is controlled to be 0.20 or less when the wire rod is loaded on a loop conveyor during said first and second cooling, wherein d is the diameter of the wire rod and L is the ring pitch; and the mechanical properties of said wire rod 4 m in length satisfy the following expressions (1) to (4):

(1) $TS^*-30 \leqq$ Average value of tensile strength ($TS_{AV}$ in MPa) $\leqq TS^*+30$, where, $TS^*=400\times\{[C]+([Mn]+[Si])/5\}+670$ and the elements in square brackets [ ] in the equation mean the contents of relevant elements in percentage, (2) Standard deviation of tensile strength (TSσ)≦30 MPa, (3) Average value of reduction of area ($RA_{AV}$)>35%, (4) Standard deviation of reduction of area (RAσ)≦4%.

2. The hot-rolled wire rod according to claim 1, wherein the loading density d/L is from 0.10 to 0.20.

3. The hot-rolled wire rod according to claim 1, wherein the average diameter of nodules in said pearlite structure is 10 μm or less.

4. The hot-rolled wire rod according to claim 1, wherein said wire rod further comprises Ni in an amount of 0.3 mass % or less, excluding zero.

5. The hot-rolled wire rod according to claim 1, wherein said wire rod further comprises, in a total amount of 0.1 mass % or less, excluding zero, at least one selected from the group consisting of Nb, V, Ti, Hf and Zr.

6. The hot-rolled wire rod according to claim 1, wherein said wire rod further comprises N in an amount of 0.01 mass % or less, excluding zero.

7. The hot-rolled wire rod according to claim 1, wherein said wire rod further comprises Al in an amount of 0.05 mass % or less, excluding zero, and Mg in an amount of 0.01 mass % or less, excluding zero.

8. The hot-rolled wire rod according to claim 1, wherein said wire rod further comprises B in an amount of 0.001 to 0.005 mass %.

* * * * *